US006467471B2

(12) United States Patent
Wakui et al.

(10) Patent No.: US 6,467,471 B2
(45) Date of Patent: Oct. 22, 2002

(54) AIR-FUEL RATIO CONTROLLER FOR AN INTERNAL-COMBUSTION ENGINE

(75) Inventors: Masayuki Wakui, Wako (JP); Wataru Inagawa, Tochigi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 165 days.

(21) Appl. No.: 09/735,929

(22) Filed: Dec. 14, 2000

(65) Prior Publication Data

US 2001/0006062 A1 Jul. 5, 2001

(30) Foreign Application Priority Data

Jan. 5, 2000 (JP) ..... 2000-000308

(51) Int. Cl.[7] ..... F02D 41/14
(52) U.S. Cl. ..... 123/674; 123/696; 123/680
(58) Field of Search ..... 123/674, 679, 123/680, 696, 695, 704, 478, 480; 701/105

(56) References Cited

U.S. PATENT DOCUMENTS 4,282,842 A * 8/1981 Sasayama ..... 123/694
4,967,713 A * 11/1990 Kojima ..... 123/696
5,299,550 A * 4/1994 Inoue ..... 123/674
5,671,720 A * 9/1997 Uchikawa ..... 123/676

FOREIGN PATENT DOCUMENTS

JP 7-92008 10/1995 ..... F02D/41/14
JP 2001-193532 A * 7/2001 ..... F02D/41/14

* cited by examiner

*Primary Examiner*—Hieu T. Vo
(74) *Attorney, Agent, or Firm*—Arent Fox Kintner Plotkin & Kahn, PLLC

(57) ABSTRACT

Even when a reaction delay time of an A/F ratio detection device changes, an A/F ratio controller prevents an A/F ratio feedback control from being disturbed. The controller is programmed to calculate an A/F ratio feedback coefficient by proportional term control and integration term control, and to set length of time for said integration term to be carried out in accordance with an operating state of the engine. It is programmed to calculate the integration term based on the set time and to set a proportional term for shifting said A/F ratio feedback coefficient. It is further programmed to detect a deviation between a first A/F ratio feedback coefficient before the integration term is carried out and a second A/F ratio feedback coefficient after the integration term is carried out and the coefficient is shifted by the proportional term set by said means for setting the proportional term. Based on the detected deviation, the length of time for the integration term to be carried out is corrected.

13 Claims, 11 Drawing Sheets

AIR-FUEL RATIO CONTROLLER FOR AN INTERNAL-COMBUSTION ENGINE

BACKGROUND OF THE INVENTION

The present invention relates to an air-fuel ratio feedback controller for controlling an A/F ratio of air-fuel mixture to be supplied to an internal-combustion engine based on output from an A/F ratio sensor provided in an exhaust system of the engine.

In A/F (air-fuel) ratio control of an engine, calculation of an A/F ratio feedback coefficient has been performed based on output from an A/F ratio sensor, such as an O2 sensor, provided upstream of an exhaust gas cleaning catalyst. The A/F ratio is increased or decreased repeatedly within a narrow range centered on a theoretical A/F ratio. The A/F ratio feedback coefficient is a coefficient used for calculating fuel injection time of a fuel injection device (injector) and is determined based on driving conditions.

Japanese Examined Patent Application Publication (Kokoku) No. 7-92008 describes a proportional integration control of the A/F ratio feedback coefficient. A proportional constant at the time of shifting the coefficient as well as the period from the time fuel supply to the engine has been changed to the time switching of the A/F ratio between rich and lean is detected by the A/F ratio sensor is predicted based on a present operating state of the engine. Integration constant in the present integration control is determined from both the proportional constant and the period thus predicted. After the A/F ratio feedback coefficient in the present integration control phase is increased or deceased according to the integration constant, the A/F ratio feedback coefficient in the next proportional control phase is increased or decreased with the predicted proportional constant. The variation range and the cycle of change of the A/F ratio are reduced and the A/F ratio rapidly converges to the stoichiometry or theoretical A/F ratio.

According to such a conventional scheme, in a case that reaction delay time of an O2 sensor increases due to such causes as deterioration of the O2 sensor because of a secular change, an A/F ratio F/B coefficient KO2 may greatly change before the output from the O2 sensor actually reverses. This is because KO2 will change at a large gradient of an integration term calculated based on the reaction delay time TRL or TLR of the O2 sensor, which is shorter than the real delay time.

Accordingly, the A/F ratio may move out of a cleaning window width of a ternary catalyst.

SUMMARY OF THE INVENTION

In order to solve such problems, the present invention provides an A/F ratio controller for an internal-combustion engine. In accordance with one aspect of the invention, the controller comprises A/F ratio detector provided in an exhaust system of an internal-combustion engine for detecting an A/F ratio of exhaust gas. The controller further comprises A/F ratio feedback coefficient calculator for calculating an A/F ratio feedback coefficient by proportional term control and integration term control. The controller includes a timer for setting length of time for the integration term to be carried out in accordance with an operating state of the internal-combustion engine. The controller includes an integration term calculator for calculating the integration term based on the time set by the timer, and proportional term setting means for setting a proportional term for shifting the A/F ratio feedback coefficient.

The controller further comprises a deviation detector for detecting a deviation between a first A/F ratio feedback coefficient before the integration term is carried out and a second A/F ratio feedback coefficient after the integration term is carried out and the coefficient is shifted by the proportional term set by said means for setting the proportional term. The controller includes means for correcting, based on the deviation, the length of time for the integration term to be carried out.

With reference to an example of the A/F ratio control phase shown in FIG. 3B, the basic concept of the technique according to the present invention will be described. At the time of reversal of the A/F ratio from rich to lean and from lean to rich, the time required to subsequently carry out the integration term is corrected according the invention. The correction is made based on a deviation between the A/F ratio feedback coefficient KO2SRL that is the coefficient before the integration term IL is carried out and the coefficient KO2SLR that is the coefficient after the integration term IL is carried out and a shift KO2WL is added.

According to the invention, the integration term is calculated based on the time thus corrected. Therefore, when a reaction delay due to a secular change or the like occurs in the A/F ratio detector, the value of the integration term becomes smaller in accordance with the delay. Thus, excessive change of the A/F ratio feedback coefficient before the output of the A/F ratio detector reverses is avoided. Thus, even when the reaction delay time changes due to deterioration or the like of the A/F ratio detector, it is possible to decrease disturbances in the A/F ratio feedback control.

In accordance with another aspect of invention, the controller further comprises means for learning a reaction delay in the A/F ratio detector based on the deviation, and means for determining deterioration of the A/F ratio detector when a learned value of said means for learning reaches an upper limit value.

According to the invention described above, deterioration of the A/F ratio detector can be detected, which is an important data source in the A/F ratio feedback control, in a normal process of the A/F ratio feedback control.

DETAILED DESCRIPTION OF THE PREFERRED EMBODIMENTS

Figure 1:
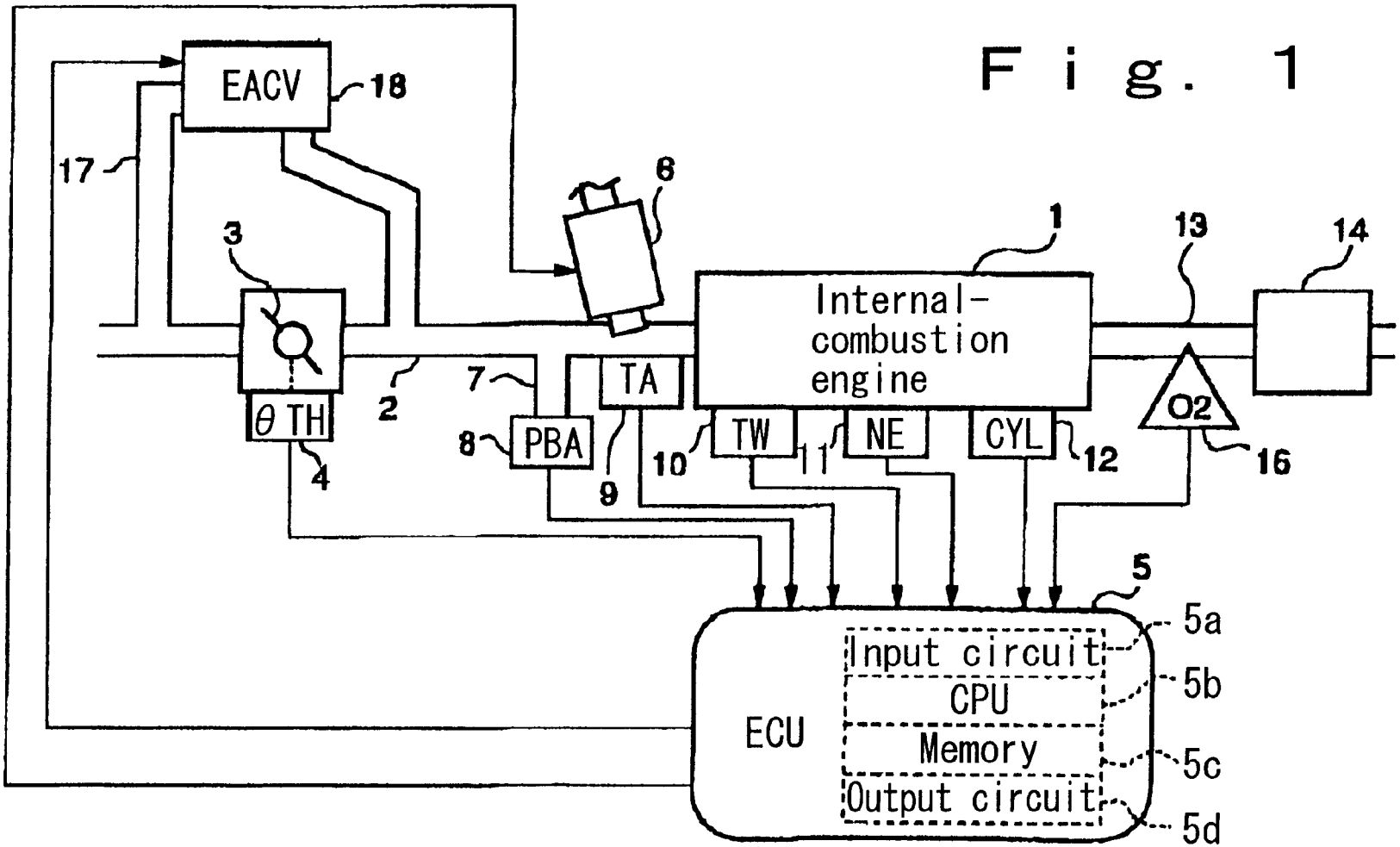
FIG. 1 is a view showing a general configuration of an engine system, to which the present invention is applied.

With reference to the drawings, embodiments according to the present invention will be described. FIG. 1 is a general view showing an engine and an A/F ratio feedback controller to which the present invention is applied, and a throttle valve 3 is disposed at some point in an intake pipe 2 of the engine 1. The throttle valve 3 is provided with a throttle valve opening (θTH) sensor 4, and an electric signal in accordance with the opening of the throttle valve 3 is transmitted to an electronic control unit (ECU) 5.

At some point in an auxiliary air passage 17, which bypasses a throttle body 3 of the intake pipe 2, there is disposed an intake secondary air control device 18 (EACV), which receives a control signal from the ECU5. The EACV 18 supplies auxiliary air to the intake pipe as intake secondary air in order to control idling speed of the engine 1.

A fuel injection valve 6 is provided between the engine 1 and the throttle valve 3 for each cylinder, and is connected to a fuel pump (not shown), and valve opening time is controlled through a signal from ECU5.

Downstream of the throttle valve 3, there is provided an intake pipe absolute pressure (PBA) sensor 8 through a pipe 7, which transmits a signal indicating the absolute pressure in the intake pipe to ECU5. Downstream thereof, there is provided an intake temperature (TA) sensor 9, which transmits a signal indicating the intake temperature to ECU5.

An engine water temperature (TW) sensor 10 provided in the body of the engine 1 typically includes a thermistor, and transmits a signal indicating the engine water temperature to ECU5. An engine speed (NE) sensor 11 and a cylinder identification (CYL) sensor 12 are provided around the camshaft or the crankshaft of the engine 1. The engine speed sensor outputs a pulse (TDC) at a predetermined crank angle position (top dead center) in every half revolution of the crankshaft, and the cylinder identification sensor outputs a pulse at a predetermined crank angle position of a specific cylinder.

A ternary catalyst (catalyst converter) 14 is disposed in an exhaust pipe 13 of the engine 1 to remove components such as HC, CO and NOx from exhaust gas. Upstream of the ternary catalyst 14 in the exhaust pipe 13, there is provided an oxygen concentration sensor 16 (O2 sensor) as an A/F ratio detector. The O2 sensor generates electric signal, of which output value changes like digital form at the theoretical A/F ratio.

The ECU5 typically comprises a microprocessor and has an input interface 5*a* with functions such as shaping the waveform of input signals from various sensors, modifying the voltage level, and converting analog signals into digital signals. It also includes a processor (CPU) 5*b*; a memory 5*c* for storing programs to be carried out by the CPU5*b* and arithmetic results; and an output interface 5*d* for transmitting driving signals to fuel injector 6 and other actuators. The memory 5*c* can comprise a read only memory (ROM) for storing a program therein, and a random access memory (RAM) for providing a work area to the CPU5*b*. A RAM with a backup function can be used in place of the ROM.

The CPU5*b* controls each portion of the engine in accordance with any of several operation modes prepared in advance, such as feedback control operation mode and open loop control operation mode, responsive to an A/F ratio obtained by detecting the exhaust gas based on a signal indicating any of various operating states. At that time, the CPU5*b* calculates fuel injection time TOUT of the fuel injection valve 6 by the following equation:

$$TOUT=T1\times KO2\times K1+K2 \quad (1)$$

TI is basic fuel injection time to be obtained from a map prepared in the memory 5*c* with the engine speed NE and intake pipe pressure PBA as parameters. K02 is an A/F ratio feedback coefficient calculated based on output from the O2 sensor 16. During A/F ratio feedback control, feedback control is performed so that an A/F ratio detected by the O2 sensor follows the target A/F ratio. While during open loop control, the A/F ratio is set to a value based on an engine operating state. K1 and K2 are an A/F ratio feedback coefficient and a correction variable respectively to be calculated in response to various parameter signals, and are set to optimize various characteristics such as fuel characteristic and acceleration characteristic responsive to the engine operating state.

Figure 2:
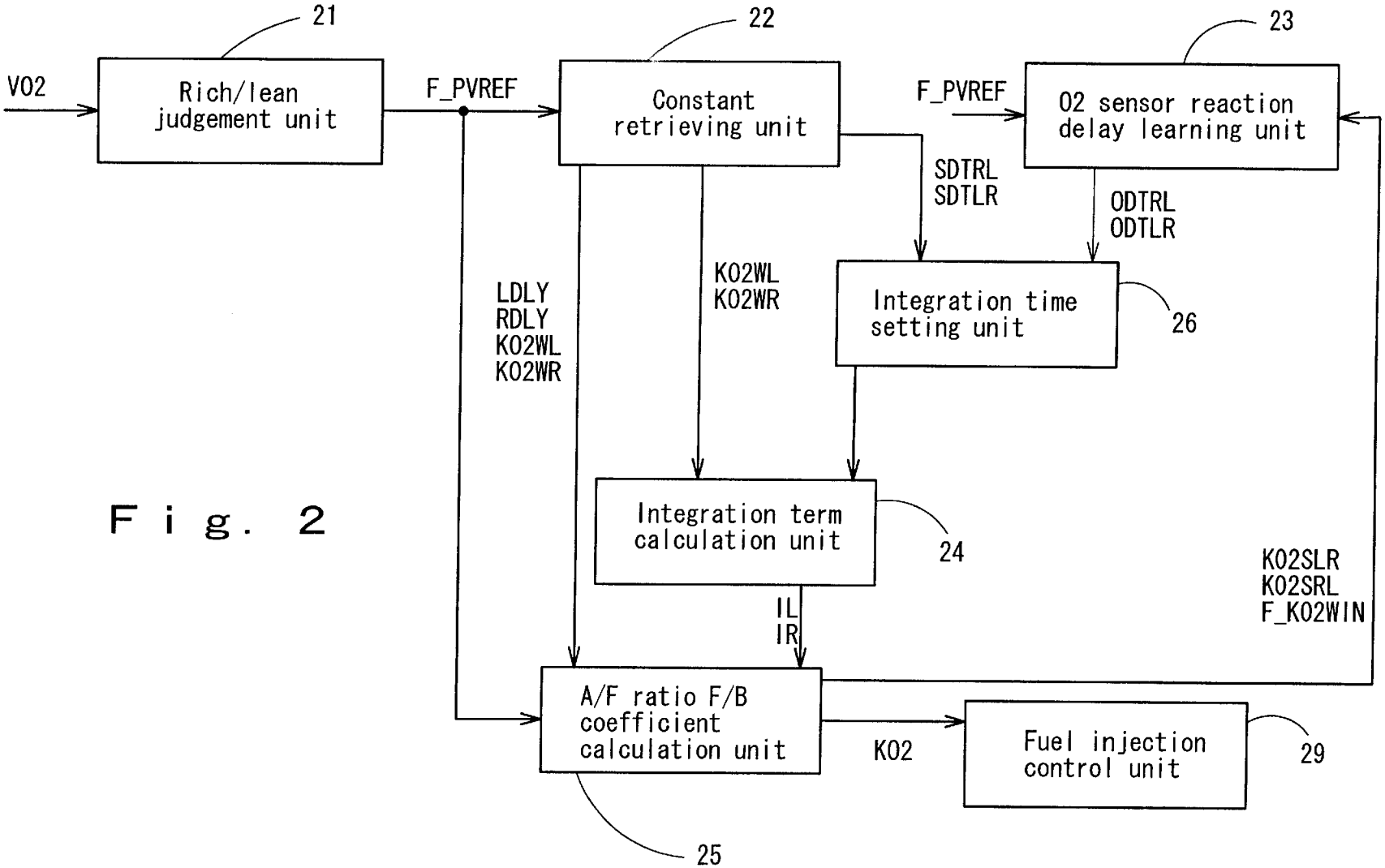
FIG. 2 is a general functional block diagram showing an A/F ratio feedback controller according to an embodiment of the present invention.
Figure 3:
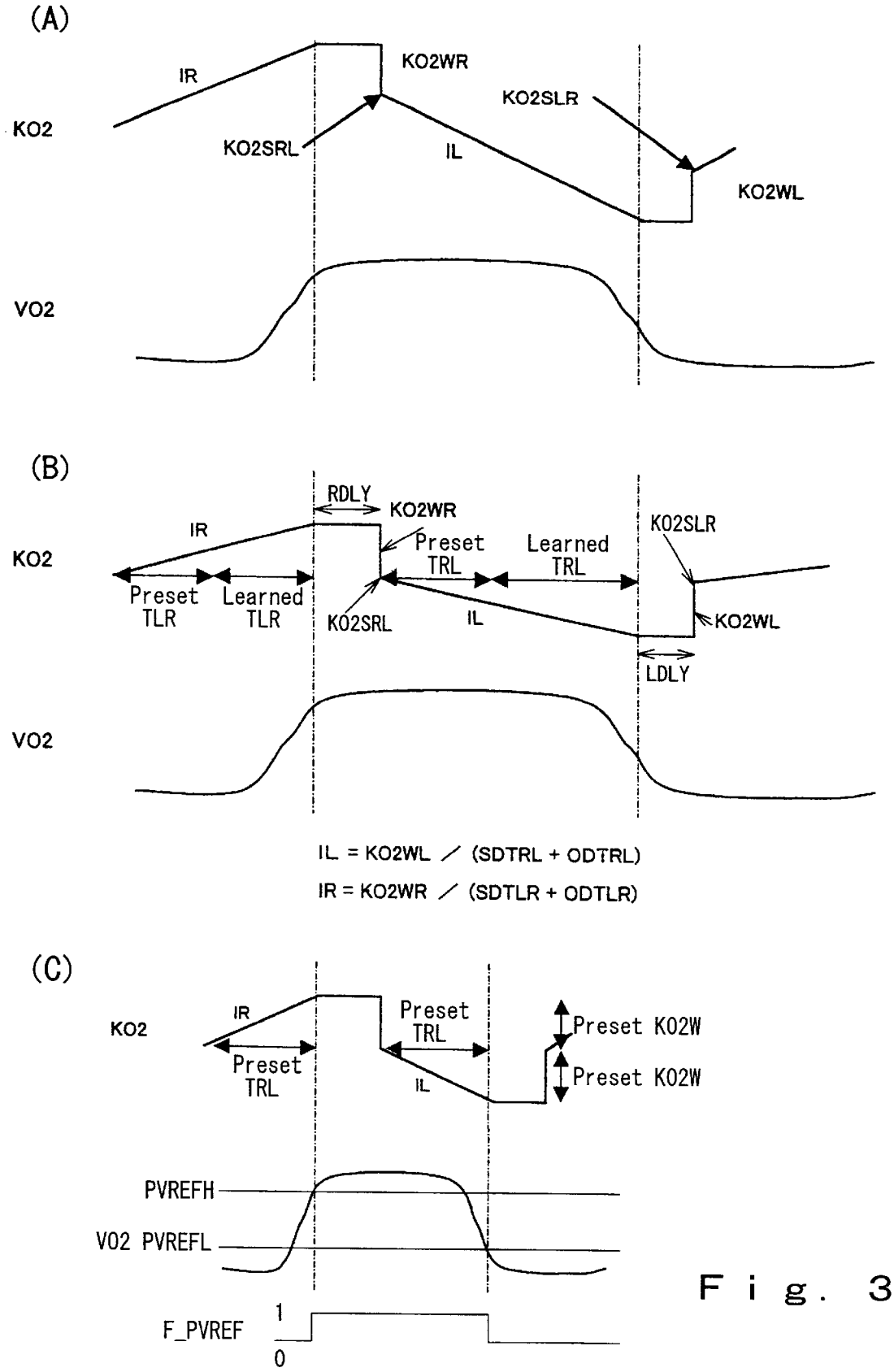
FIG. 3A shows a relationship between an A/F ratio feedback coefficient K02 and a sensor output V02 according to the prior art when a reaction delay time due to deteriorated O2 sensor occurs.
FIG. 3B shows a relationship between K02 and V02 when using a control scheme wherein reaction delay time due to deterioration of the O2 sensor is learned in accordance with the present invention.
FIG. 3C is a view showing a relationship between detection output of the O2 sensor and O2 sensor reversal flag.

FIG. 2 is a functional block diagram for ECU5 according to an embodiment of the present invention. A rich/lean judgment unit 21 judges whether the A/F ratio enters a rich area or a lean area based on an output signal VO2 from the O2 sensor 16. When VO2 crosses an upper threshold PVREFH upward from under as shown in FIG. 3C, it is determined that the A/F ratio has entered the rich area and an O2 sensor reversal flag F_PVREF is set to 1. When VO2 crosses a lower threshold PVREFL downward from above, it is determined that the A/F ratio has entered the lean area and the O2 sensor reversal flag F_PVREF is reset to 0.

FIG. 3A shows the relationship in the A/F ratio feedback according to the prior art between the A/F ratio feedback coefficient KO2 and output VO2 from the A/F ratio detector when the O2 sensor 16 has been deteriorated. FIG. 3B generally shows the relationship between the A/F ratio feedback coefficient KO2 and output VO2 from the A/F ratio detector when the integration time has been corrected according to the present invention.

Referring to FIG. 2, an F/B constant retrieving unit 22 determines various constants required in an embodiment of the present invention. Referring to FIG. 3B, one of these constants is duration RDLY during which the A/F ratio feedback coefficient K02 is kept constant in the rich area after the A/F ratio enters the rich area, that is, a delay time by the time controlling of orienting the A/F ratio to lean starts. In a control cycle to switch the A/F ratio from the lean side to the rich side, LDLY shown in FIG. 3B corresponds to this delay time. This time is determined based on the operating state, and in this embodiment, the time is read out from a table (stored in the memory 5*c*) in which an intake air amount correlated value (value obtained by multiplying the engine speed by a basic injection amount) is used as a parameter. This table is stored as a 10-point lattice table with interpolation calculation for saving the capacity of the memory 5*c* in an embodiment.

Other constants to be retrieved by the retrieving unit 22 include shift amounts K02WR and K02WL, which are called "proportional term (P term)", and which shifts the A/F ratio feedback coefficient K02 from rich toward lean, and from lean toward rich. Each constant is determined based on the operating state of the engine, and is, in this embodiment, read out from each table having the intake air amount correlated value as a parameter. Each table is also stored in the memory 5*c* as the 10-point lattice table with interpolation calculation.

Further another constant to be retrieved by the retrieving unit 22 is a time required to control the integration term (I term), that is, the time that ought to elapse to enter a lean area after the RDLY time has elapsed shifting the A/F ratio by the proportional term. In the example of FIG. 3B, it is a time by which the lean/rich judgment unit 21 resets (meaning "lean") the O2 sensor reversal flag F_PVREF to 0 based on the O2 sensor output VO2.

The retrieving unit 22 reads out SDTRL and SDTLR, which are preset TRL and preset TLR respectively, from a table stored in the memory 5*c* with the operating state as parameters. SDTRL and SDTLR are passed to an integration time setting unit 26. The preset TRL or preset TLR is reaction delay time of the O2 sensor. The preset TRL and preset TLR can be read out from a table stored in the memory 5*c* with the operating state as a parameter. In this embodiment, the preset TRL and preset TLR can be read out from a table stored in the memory 5*c* as a 10-point lattice table with interpolation calculation having the intake air amount correlated value as a parameter.

An O2 sensor reaction delay time learning unit 23 learns the influence of the reaction delay time which may occur because of deterioration of the O2 sensor and determines learned TRL and learned TLR (ODTRL and ODTLR) for correcting the preset TRL and preset TLR, and sends ODTRL and ODTLR to an integration time setting unit 26.

The learned TRL and learned TLR are read out from a table having the operating state as parameters, which is rewritten by a delay learning unit 23. In this embodiment, the learning table is stored in the memory 5*c* as the 10-point lattice table with interpolation calculation having the intake air amount correlated value (the product of engine speed and basic injection amount) as a parameter.

The inventor of the present invention identified the following problems which may occur under the prior art. When the reaction delay in the O2 sensor caused by deterioration is not corrected, that is, when reaction delay in the O2 sensor due to deterioration occurs, a deviation is produced between K02SRL and KO2SLR. The former is a value of the A/F ratio feedback coefficient K02 before the integration term IL is carried out. The latter is a value of the A/F ratio feedback coefficient after the integration term IL is carried out and the proportional term KO2WL is added. Such a deviation can be seen in FIG. 3A.

The former coefficient K02SRL can be regarded as a value of the A/F ratio feedback coefficient K02 when the proportional term K02WR has been carried out, and the latter coefficient K02SLR can be regarded as a value of the A/F ratio feedback coefficient when the proportional term K02WL has been carried out.

Figure 9:
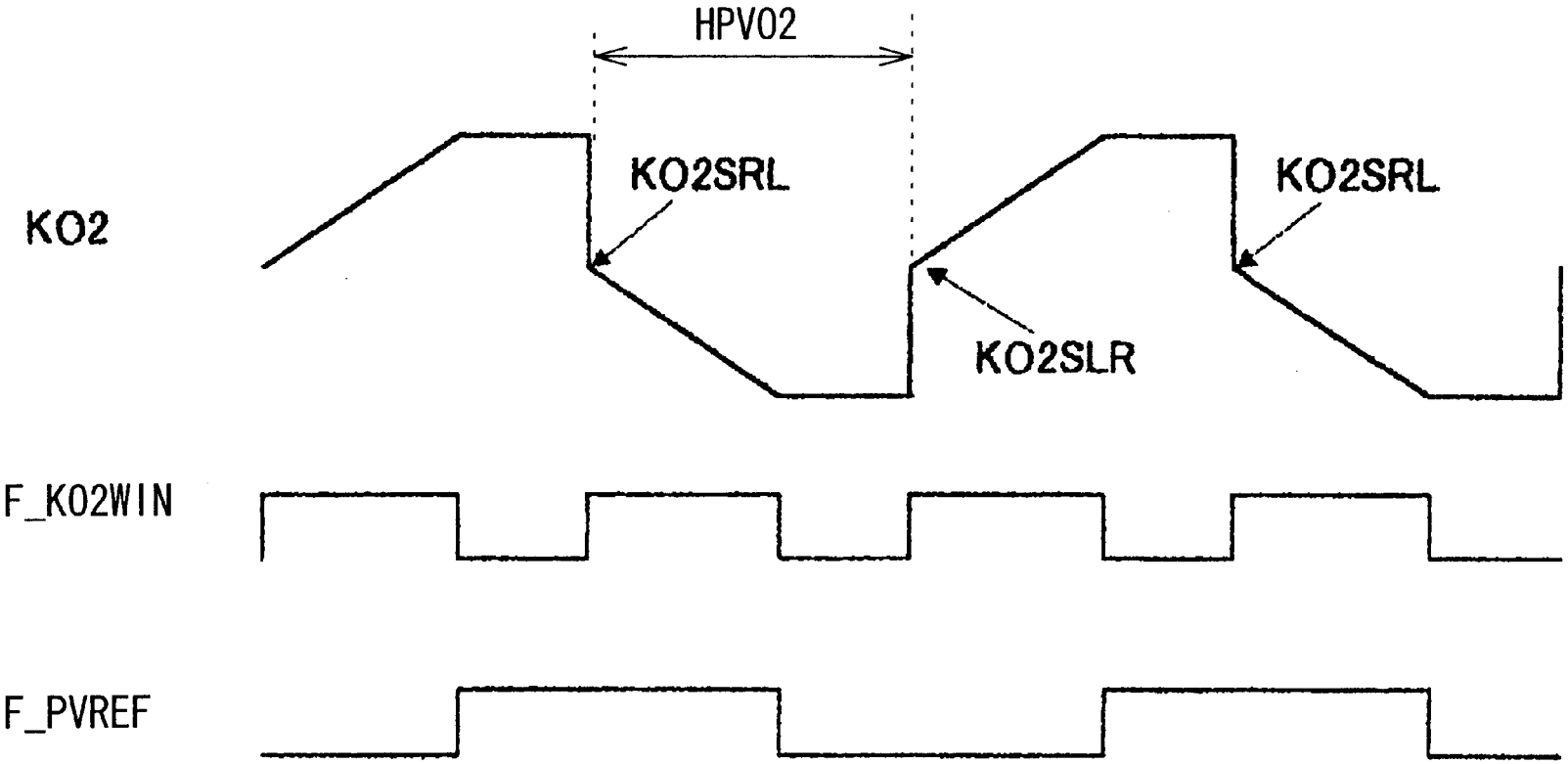
FIG. 9 is a view showing a timing relationship between the A/F ratio feedback coefficient K02, the proportional term execution flag F_K02WIN, and O2 sensor reversal flag F_PVREF.
Figure 10:
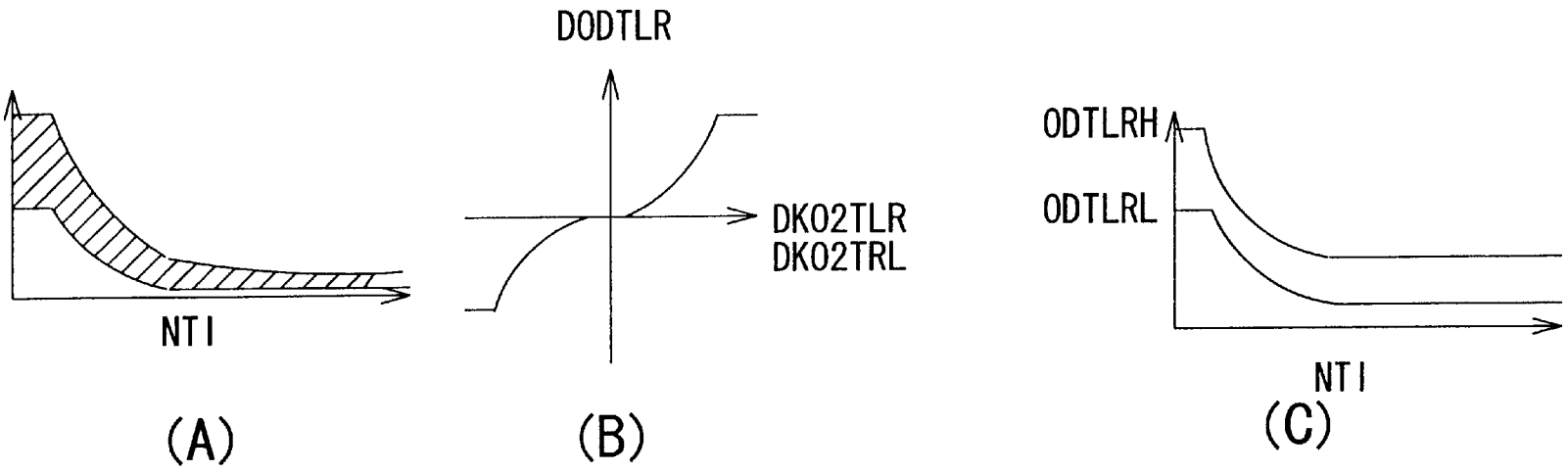
FIG. 10A shows a table in which the upper limit and lower limit of intervals in the execution of the proportional term are acquired.
FIG. 10B shows a table in which a correction amount for delay time based on the deviation of the A/F ratio feedback coefficient K02 is acquired.
FIG. 10C is a conceptual view for a learning table showing delay time correction amount responsive to the operating state.

The delay learning unit 23 periodically updates the learning table based on the correlation between the deviation and additional reaction delay time of the O2 sensor so as to enable the above described integration time to be properly corrected. The details of this operation will be described hereafter With reference to FIGS. 8 to 10.

The integration time setting unit 26 receives SDTRL and SDTLR, which are O2 sensor reaction delay time, from the constant retrieving unit 22, and receives learned values ODTRL and ODTLR from the O2 sensor reaction delay learning unit 23, and sets a time required to carry out the integration term (I term), that is, integration time.

An integration term calculation unit 24 calculates the integration term through the following equation on the basis of shift amounts (proportional items) K02WL and K02WR, obtained from the constant retrieving unit 22, and integration time obtained from the integration time setting unit:

$$IL=KO2WL/(SDTRL+ODTRL),$$

$$IR=KO2WR/(SDTLR+ODTLR), \quad (2)$$

where IL is a gradient of integration when the A/F ratio feedback coefficient changes from a rich side to a lean side. IR is a gradient of integration when the A/F ratio feedback coefficient changes from the lean side to the rich side conversely.

As shown in FIG. 3B, K02WL is a shift amount (proportional term) when the A/F ratio feedback coefficient changes from the lean side to the rich side, and K02WR is a shift amount (proportional term) when the coefficient changes from the rich side to the lean side. Thus, accumulation of integration terms while the A/F ratio feedback coefficient is changed from the rich side to the lean side is equal to shift amounts (proportional terms) when the A/F ratio feedback coefficient is subsequently changed from the lean side to the rich side. Therefore, the A/F ratio feedback coefficient K02SRL after shifted from the rich side to the lean side is equal to the coefficient K02SLR after shifted from the lean side to the rich side as long as the integration time (SDTRL+ODTRL or SDTLR+ODTLR) corresponds accurately to the reaction delay time of the O2 sensor.

An A/F ratio feedback coefficient calculation unit 25 calculates an A/F ratio feedback coefficient KO2 in accordance withholding time (RDY and LDY), shift amounts (K02WL and K02WR) which are obtained from the constant retrieving unit 22, integration terms (IL and IR) and integration time (SDTRL+ODTRL and SDTLR+ODTLR). They are obtained from the integration term calculation unit 24. The resulting A/F feedback coefficient K02 is passed to a fuel injection control unit 29. The fuel injection control unit 29 controls the injection amount of the fuel by the use of the coefficient.

Figure 4:
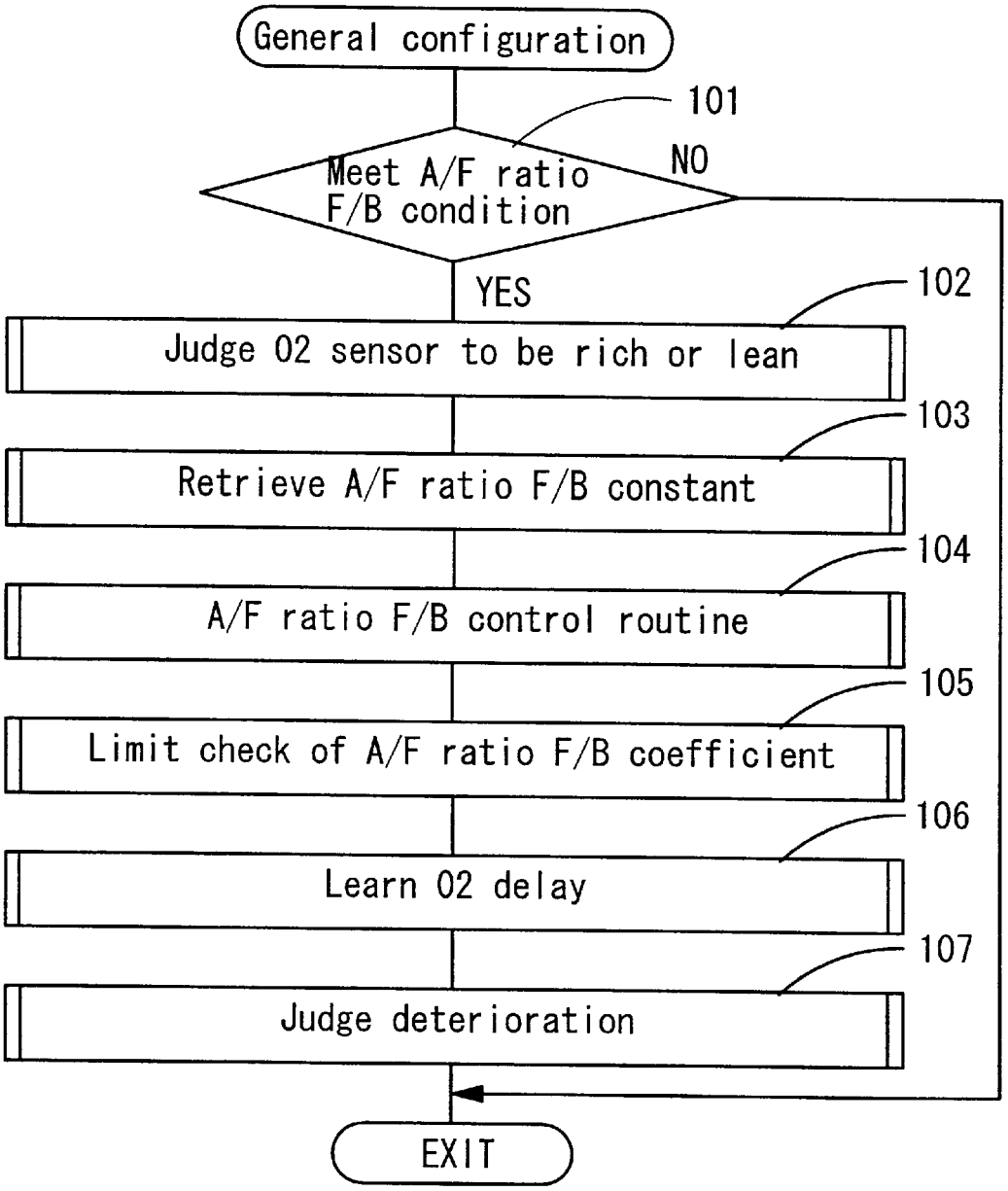
FIG. 4 is a view showing a general configuration of a program routine in an embodiment of the present invention.

Next, with reference to the flowcharts, the details of each functional block shown in FIG. 2 are described. FIG. 4 shows a configuration of a program module when the present invention is integrated into a program of the ECU5. It is determined whether the operating state of the engine meets the conditions for executing the A/F ratio feedback control operation (101). If yes, the A/F ratio feedback control according to the present invention will start.

The program includes a routine 102 for determining whether the A/F ratio is lean or rich based on the output from the O2 sensor. It also includes a routine 103 for retrieving the A/F ratio feedback constant, a routine 104 for performing the A/F ratio feedback control, a routine 105 for performing limit check of the A/F ratio feedback coefficient, a routine 106 for learning reaction delay of the O2 sensor, and a routine 107 for determining whether the O2 sensor is deteriorated.

Figure 5:
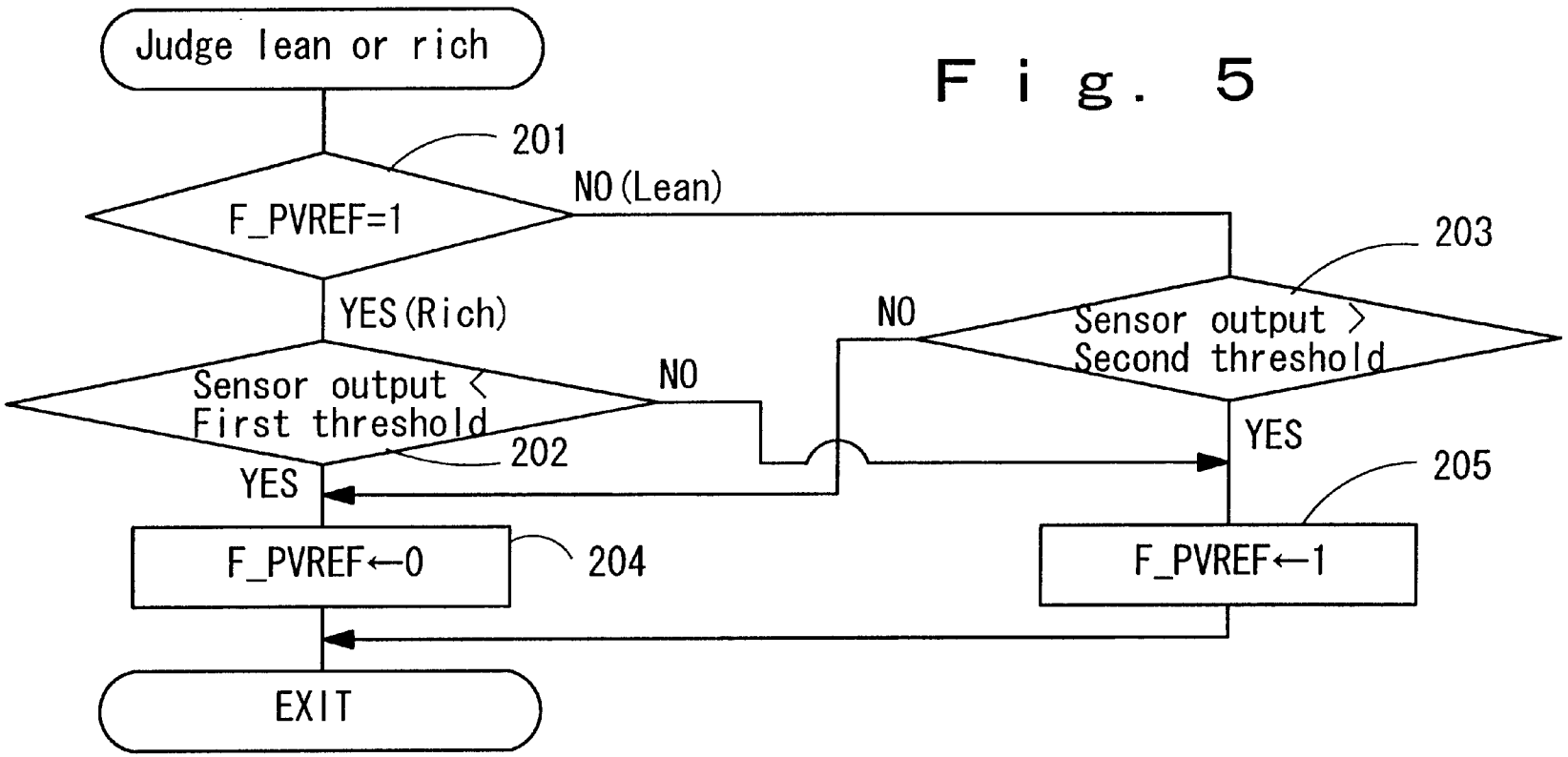
FIG. 5 is a flowchart showing a routine in which lean or rich A/F is determined.
Figure 7:
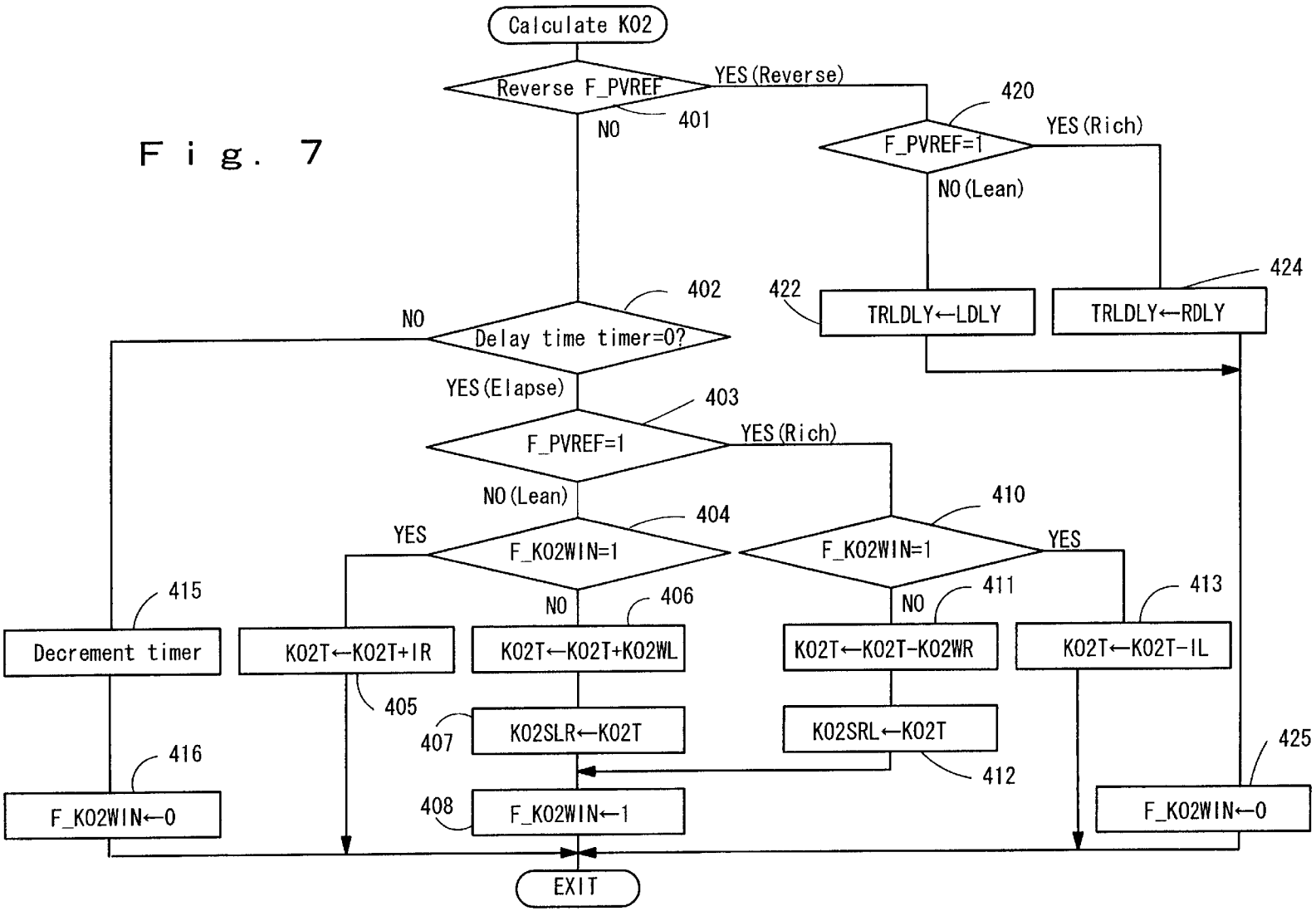
FIG. 7 is a flowchart showing a routine in which an A/F ratio feedback coefficient K02 is calculated in an embodiment according to the present invention.
Figure 8:
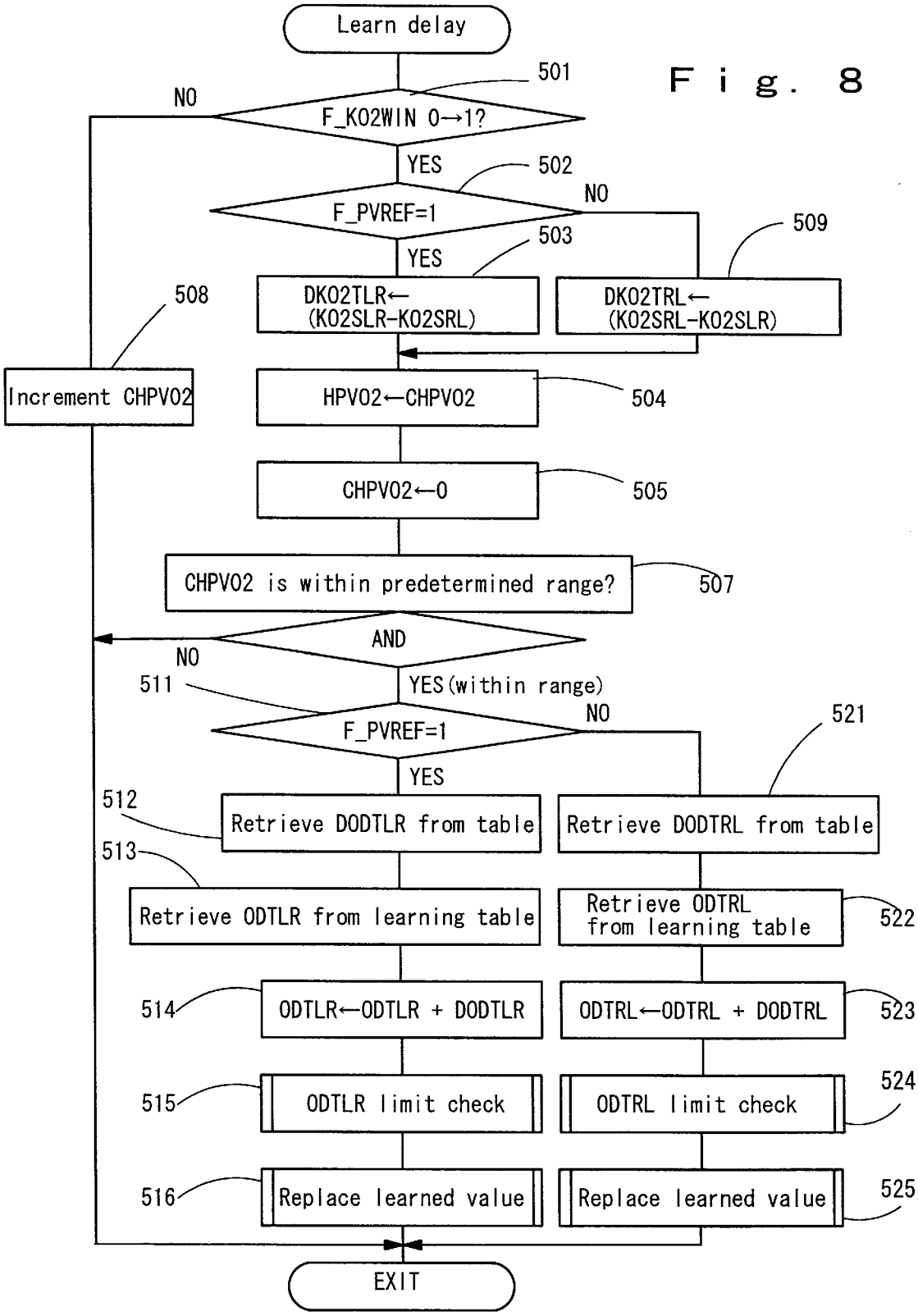
FIG. 8 is a flowchart showing a routine which learns a constant used for calculating the A/F ratio feedback coefficient K02 by reflecting the reaction delay time of the O2 sensor in an embodiment according to the present invention.

FIG. 5 is a flowchart showing the details of the routine 102 for determining lean or rich, and functionally corresponds to the rich/lean judgment unit 21 of FIG. 2. This routine is carried out at predetermined intervals, for example, every 10 milliseconds. The routines shown in FIGS. 6 to 8 are similarly carried out at predetermined intervals, for example, every 10 milliseconds.

It is determined whether the O2 sensor reversal flag F_PVREF (See waveform of FIG. 3C) is 1 (201), and if it is 1 (rich state) it will be determined whether the sensor output VO2 is below a lower threshold (first threshold) PVREFL (202). When the VO2 is below the lower threshold or first threshold PVREFL, the reversal flag F_PVREF is reset to 0 (204), which indicates a lean state. When the reversal flag is 0 in step 201, it is checked whether the sensor output V02 is above the upper threshold, or the second threshold PVREFH (203). If yes, the reversal flag is set to 1 (205), and it indicates a rich state. If it is determined to be "NO" in steps 202 and 203, the process will proceed to step 205 and step 204 respectively.

Figure 6:
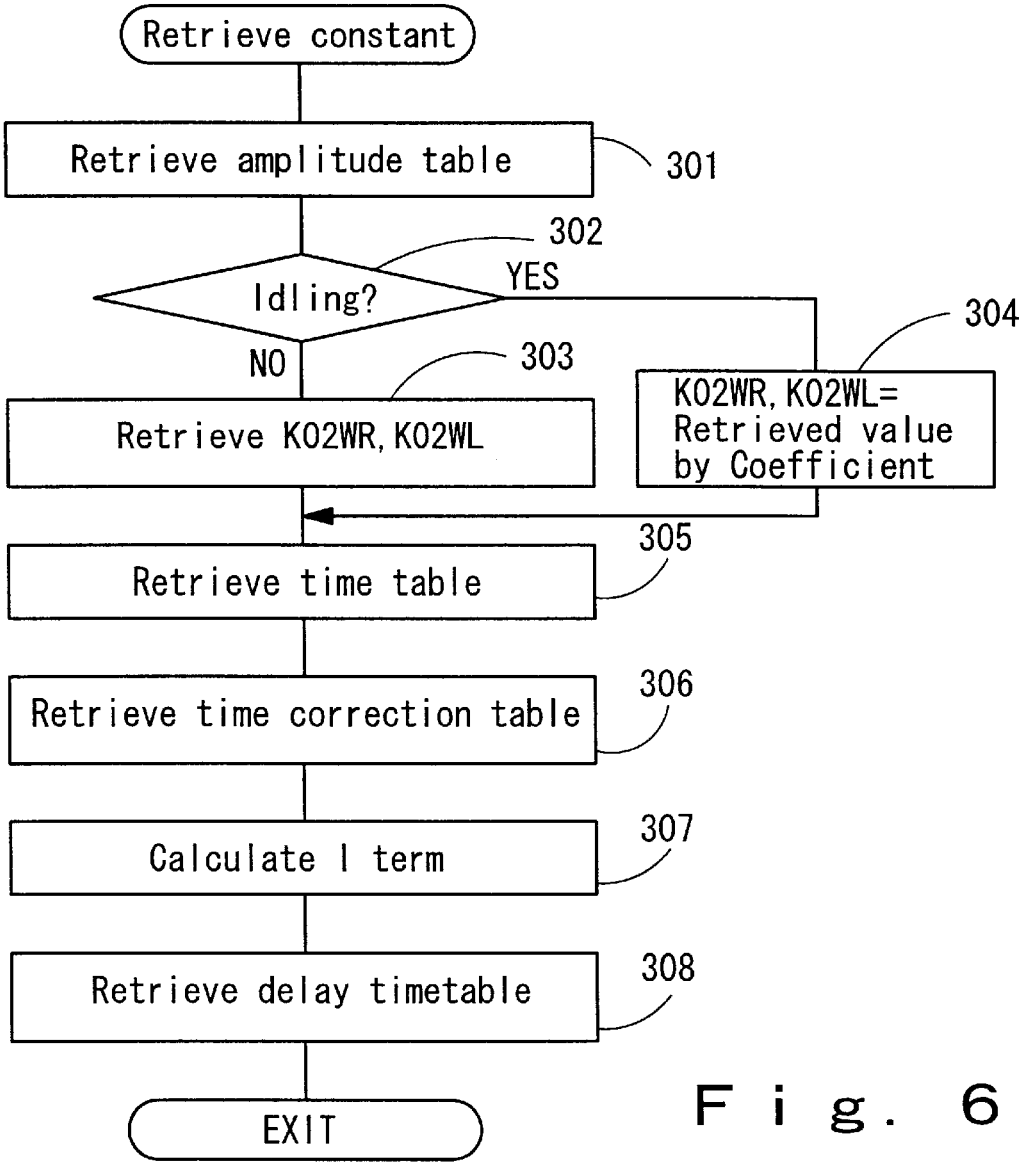
FIG. 6 is a flowchart showing a routine in which a constant used in an embodiment according to the present invention is retrieved.

FIG. 6 is a flowchart showing a process for retrieving various constants from the memory 5*c*, and substantially corresponds to the constant retrieving unit 22 of FIG. 2 functionally. A shift amount (proportional term) of the A/F ratio feedback coefficient corresponding to the intake air amount correlated value (product of engine speed and basic injection amount) at this point of time is read out from an amplitude table stored in the memory 5*c* (301). As the amplitude table, both a table indicating the shift amount from rich to lean, and a table indicating the shift amount from lean to rich are prepared. As described above, these tables are stored in the memory 5*c* in the form of a 10-point lattice table with interpolation calculation.

Next, whether the engine is in an idling state (302) is checked. If in the idling state, the shift amount (proportional term) K02WR and K02WL are obtained by multiplying a value read out from the amplitude table with a coefficient smaller than 1 (304). If not in the idling state, the value read out from the amplitude table become the shift amount as it is (303). The shift amounts K02WR and K02WL have been described above with reference to FIG. 3B. In idling state, the K02WR and K02WL are set smaller than those in other states to allow reduction of fluctuation of the A/F ratio.

O2 sensor reaction delay time basic values (SDTRL and SDTLR) corresponding to the present intake air amount correlated value will be read out from the 10-point lattice table (with interpolation calculation) using the intake air amount correlated value NTI (305). Similarly, O2 sensor reaction delay learned values (ODTRL and ODTLR) corresponding to the present intake air amount correlated value will be read out from the 10-point lattice learning table (with interpolation calculation) using the intake air amount correlated value NTI (306). The integration terms IL and the IR are calculated with constants read out in this manner by the equation (2) described above (307).

Similarly, delay time LDLY and RDLY for executing a shift amount (proportional term) of the A/F ratio feedback coefficient K02 are read out from the 10-point lattice table (with interpolation calculation) using the intake air amount correlated value NTI (308). The delay time LDLY and RDLY have been described above with reference to FIG. 3B.

FIG. 7 is a flowchart showing a routine for calculating the A/F ratio feedback coefficient K02 in the A/F ratio feedback control, and substantially corresponds to the block 25 of FIG. 2. By monitoring the O2 sensor reversal flag (F_PVREF in FIG. 3C), whether the flag has been reversed is watched(401). If not reversed, whether the timer of delay time TRLDLY in the proportional term has become 0 is determined, that is, whether delay time of the proportional term has elapsed is determined (402). If no, the timer is decremented (415) and the proportional term execution flag F_K02WIN is reset to 0 (416).

When the proportional term delay time has elapsed in the step 402, whether the O2 sensor reversal flag F_PVREF is 1 (rich) or 0 (lean) is determined (403). If it is lean, the process proceeds to step 404 to determine whether or not the proportional term has been carried out, that is, whether or not the A/F ratio feedback coefficient has been shifted by the shift amount K02WL by viewing the proportional term execution flag F_K02WIN (404). If the proportional term has not been carried out, F_K02WIN is 0. Therefore the shift amount K02WL will be added to the present instantaneous value K02T of the A/F ratio feedback coefficient, and this value will be set as a new instantaneous value for the A/F ratio feedback coefficient (406). The new instantaneous value which has just been shifted is stored in a predetermined storage area of the memory 5*c* as the parameter K02SLR (407). Then, the proportional term execution flag F_K02WIN is set to 1 (408) and the process ends.

When the proportional term execution flag is 1 in the step 404, the process proceeds to step 405 to set a value obtained by adding the integration term IR to the present instantaneous value K02T of the A/F ratio feedback coefficient as a new instantaneous value of the A/F ratio feedback coefficient, and the process ends.

When the O2 sensor reversal flag is 1 (indicating the rich state) in the step 403, the process proceeds to step 410 to judge whether the proportional term execution flag becomes 1. When it is not 1, that is, when the proportional term is not carried out, the shift amount K02WR obtained above is deducted from the present instantaneous value K02T of the A/F ratio feedback coefficient, and this value is set as a new instantaneous value of the A/F ratio feedback coefficient (411). The instantaneous value of the A/F ratio feedback coefficient, which has just been shifted, is stored in a predetermined storage area of the memory 5*c* as a variable K02SRL (See FIG. 3B) (412). Then the proportional term execution flag is set to 1 (408) and the operation exits this process.

When the proportional term execution flag is 1 in the step 410, the integration term IL obtained above is deducted from the present instantaneous value K02T of the A/F ratio feedback coefficient, and this value is set as a new instantaneous value K02T and the operation exits this process.

When reversal of the O2 sensor reversal flag is detected in the step 401, whether the reversal flag F_PVREF is in the rich state or the lean state is determined (420). If in the lean state, delay time LDLY of the K02 shift obtained in the block 308 of FIG. 6 is set in the timer TRLDLY (422). This timer is checked in the above described step 402, and is decremented in the step 415. The proportional term execution flag F_K02WIN is reset and the operation exits this process (425).

When in a rich state in the step 420, delay time RDLY of the shift obtained in the block 308 of FIG. 6 is set in the timer TRLDLY (424). The proportional term execution flag F_K02WIN is reset and the operation exits this process (425).

FIG. 8 is a routine for learning O2 sensor reaction delay time, which substantially corresponds to the learning unit 23 of FIG. 2. Whether or not the proportional term execution flag F_K02WIN(which is set to 1 in the block 408 of FIG. 7) has changed from 0 to 1 is checked (501). When it has changed, whether or not the O2 sensor reversal flag F_PVREF is 1 is checked (502). If it is 1, a deviation DK02TLR between a variable K02SLR stored in the memory 5*c* in the block 407 of FIG. 7 and a variable K02SRL stored in the memory 5*c* in the block 412 is calculated (503) Similarly, when the O2 sensor reversal flag is 0, a deviation DK02TRL between the variable K02SRL and the variable K02SLR is calculated (509). Next, a value of a counter CHPV02 for measuring duration HPV02 (See FIG. 9) between execution of the proportional term and next execution of the proportional term is read (504) and the counter is reset to 0 (505).

Whether or not the duration HPV02 is within a predetermined range is determined (507). If not, the operation exits the process. Thus, parameters under certain conditions are not reflected in the learning. Such conditions include a situation where duration HPV02 temporarily becomes excessively short, and a situation where it temporarily becomes excessively long. The upper limit value and lower limit value used in the determination. are read out from the 10-point lattice table (with interpolation calculation) having the intake air amount correlated value NTI shown in FIG. 10A as a parameter.

When the duration HPV02 is between the upper limit value and the lower limit value read out from the table of FIG. 10A, and when the O2 sensor reversal flag F_PVREF is 1 (rich), the process proceeds to the block 512 to retrieve an update amount DODTLR from a table as shown in FIG. 10B using the deviation DKO2TLR obtained in the block 503 as a parameter (512). Then, the process proceeds to a block 513 to retrieve learned values ODTLR from the ODTLR learning table (the 10-point lattice table (with interpolation calculation) having the intake air amount correlated value NTI as a parameter). The update amount obtained in the block 512 is added to the learned value ODTLR thus retrieved (514). After the learned value ODTLR is obtained, whether or not this value exceeds a limit value ODTLRH or ODTLRL read out from the table of limit values (FIG. 10C) is checked (515). The ODTLR learned value table is replaced with the learned value ODTLR calculated in this process (516). Thus, whenever the deviation DKO2TLR occurs, the learned value table changes by a value shown in the table of FIG. 10B. The correlation between delay of reaction time due to deterioration of the O2 sensor and the deviation DKO2TLR has been obtained by experiments in advance, and the values in the table of FIG. 10B are set in accordance with the correlation.

When the O2 sensor reversal flag is 0 in the block 511, the process proceeds to a block 521 to retrieve the constant DODTRL from the same table for DODTRL as shown in FIG. 10B with the deviation DKO2TRL obtained in the block 509 (521). The learned value ODTRL is retrieved from the ODTRL learning table (522) and added by the constant DODTRL retrieved in the block 521 (523). Then, limit check is performed to this learned value calculated in this process with the limit value obtained by retrieving the same table as FIG. 10C (524) and the learning table is replaced with the new learned value ODTRL (525).

When the proportional term execution flag F_K02WIN is 0 in the block 501, the process proceeds to a block 508 and a counter CHPV02 for measuring intervals between executions of the proportional term is incremented. The table shown in FIG. 10 may have different values for each case of F_PVREF=1 or F_PVREF=0.

Learned values ODTLR and ODTRL obtained in the blocks 514 and 523 respectively are used to calculate the integration term, or the gradient for changing the A/F ratio feedback coefficient in the block 307 of FIG. 6.

Figure 11:
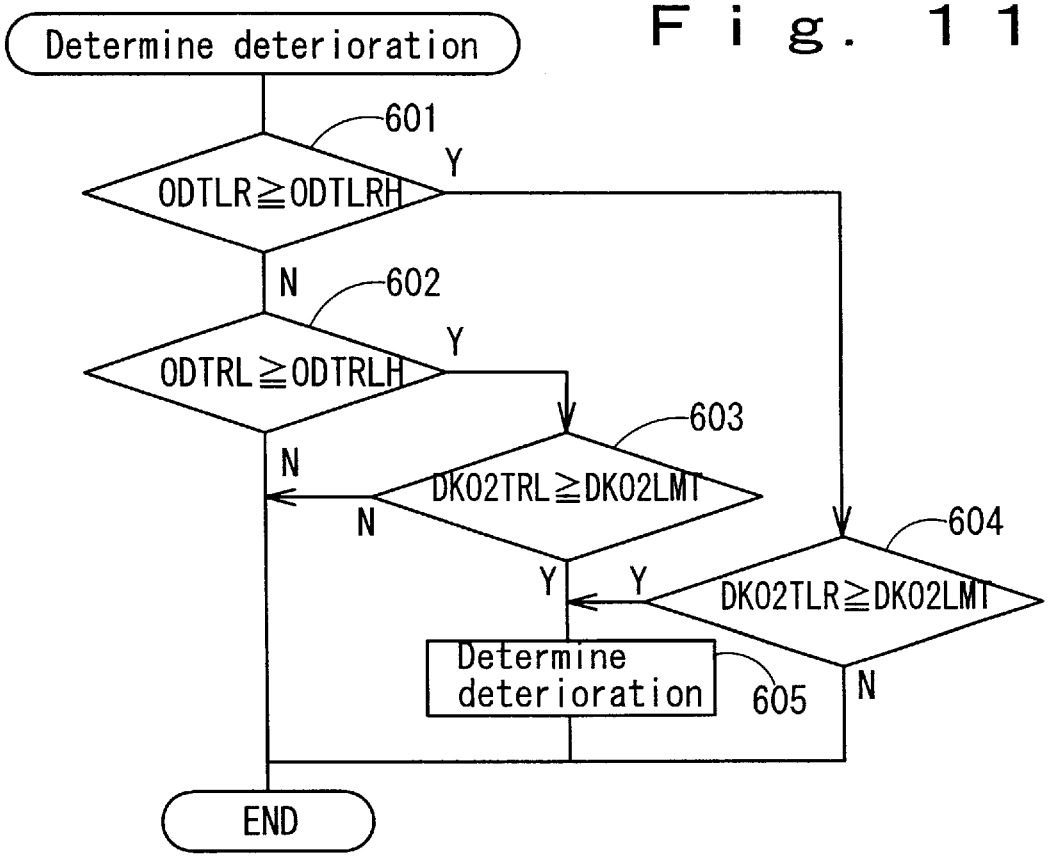
FIG. 11 is a flowchart showing a process in which deterioration of the O2 sensor is determined.

FIG. 11 shows a routine for determining deterioration. The O2 sensor is determined to be deteriorated (605) if the learned value ODTLR reaches the upper limit value ODTLRH in the limit check of step 515 of FIG. 8 (601), and if the deviation DKO2TLR calculated in the step 503 of FIG. 8 exceeds a deterioration determining value DK02LMT (604). Further, the O2 sensor is determined to be deteriorated (605) if the learned value ODTRL reaches the upper limit value ODTRLH in the limit check of step 524 of FIG. 8 (602), and if the deviation DKO2TRL calculated in the step 509 of FIG. 8 exceeds the deterioration determining value DKO2LMT (603).

While the preferred embodiment of the present invention has been described in the foregoing, the present invention is not limited to such embodiments but includes variations obvious for those skilled in the art. For example, the engine operating state may be determined based on various parameters.

According to the present invention, even when the reaction delay time changes due to deteriorated A/F ratio detector or the like, it is possible to reduce any disturbances in the A/F ratio feedback control.

In addition, according to another aspect of the invention, it is possible to detect deterioration of A/F ratio detector during the process of A/F ratio feedback control.

What is claimed is:

1. An air-fuel ratio controller for an internal-combustion engine, comprising:

an air-fuel ratio detector provided in an exhaust system of the engine for detecting an air-fuel ratio of exhaust gas;

means for calculating an A/F ratio feedback coefficient by proportional term control and integration term control;

a timer for setting length of time for the integration term to be carried out in accordance with an operating state of the engine;

means for calculating said integration term on the basis of time set by said timer; and means for setting the proportional term for shifting the A/F ratio feedback coefficient, a deviation detector for detecting a deviation between a first A/F ratio feedback coefficient before the integration term is carried out and a second A/F ratio feedback coefficient after the integration term is carried out and the coefficient is shifted by the proportional term set by said means for setting the proportional term; and means for correcting, based on the deviation, the length of time for the integration term to be carried out.

2. The controller of claim 1 further comprising;

means for learning a reaction delay in the A/F ratio detector based on the deviation; and means for determining deterioration of the A/F ratio detector when a learned value of said means for learning reaches an upper limit value.

3. The controller of claim 1, wherein said means for setting the proportional term sets a smaller proportional term when the operating state is idling.

4. The controller of claim 2, wherein said means for correcting corrects the length of time for the integration term to be carried out based on the learned reaction delay.

5. An air-fuel ratio controller for an internal-combustion engine, comprising an electronic control unit with an air-fuel ratio detector provided in an exhaust system of the engine for detecting an air-fuel ratio of exhaust gas, said electronic control unit being programmed to:

calculate an A/F ratio feedback coefficient by proportional term control and integration term control;

set length of time for said integration term to be carried out in accordance with an operating state of the engine;

calculate the integration term based on the set time;

set the proportional term for shifting said A/F ratio feedback coefficient, detect a deviation between a first A/F ratio feedback coefficient before the integration term is carried out and a second A/F ratio feedback coefficient after the integration term is carried out and the coefficient is shifted by the proportional term set by said means for setting the proportional term; and to correct, based on the detected deviation, the length of time for the integration term to be carried out.

6. The controller of claim 5 wherein said electronic control unit comprises a microprocessor.

7. The controller of claim 6 wherein the microprocessor is programmed to:

learn a reaction delay in said A/F ratio detector based on the deviation; and determine deterioration of the A/F ratio detector when a learned value of said learning means reaches an upper limit value.

8. The controller of claim 5, wherein the proportional term is set to a smaller value when the operating state is idling.

9. The controller of claim 5, wherein the length of time for the integration term to be carried out is corrected based on the learned reaction delay.

10. Method for controlling an air-fuel ratio of an internal-combustion engine having an electronic control unit with an air-fuel ratio detector provided in an exhaust system of the engine for detecting an air-fuel ratio of exhaust gas, comprising:

calculating an A/F ratio feedback coefficient by proportional term control and integration term control;

setting length of time for said integration term to be carried out in accordance with an operating state of said internal-combustion engine;

calculating the integration term based on the set time;

setting the proportional term for shifting said A/F ratio feedback coefficient, detecting a deviation between a first A/F ratio feedback coefficient before the integration term is carried out and a second A/F ratio feedback coefficient after the integration term is carried out and the coefficient is shifted by the proportional term set by said means for setting the proportional term; and correcting, based on the detected deviation, the length of time for the integration term to be carried out.

11. The method of claim 10 further comprising:

learning a reaction delay in said A/F ratio detector based on the deviation; and determining deterioration of the A/F ratio detector when a learned value of said learning means reaches an upper limit value.

12. The method of claim 10, wherein the proportional term is set to a smaller value when the operating state is idling.

13. The method of claim 10, wherein the length of time for the integration term to be carried out is corrected based on the learned reaction delay.

* * * * *